US007021912B2

(12) United States Patent
Tsuchiya et al.

(10) Patent No.: US 7,021,912 B2
(45) Date of Patent: Apr. 4, 2006

(54) SCROLL FLUID MACHINE

(75) Inventors: Takeshi Tsuchiya, Chiyoda (JP); Takao Mizuno, Shizuoka (JP); Mutsunori Matsunaga, Shizuoka (JP); Masaru Ohtahara, Shizuoka (JP); Syunsuke Yasunori, Shizuoka (JP); Isao Hayase, Tsuchiura (JP); Isamu Tsubono, Ushiku (JP); Kazuyuki Fujimura, Chiyoda (JP)

(73) Assignee: Hitachi, Ltd., Tokyo (JP)

( * ) Notice: Subject to any disclaimer, the term of this patent is extended or adjusted under 35 U.S.C. 154(b) by 134 days.

(21) Appl. No.: 10/656,226

(22) Filed: Sep. 8, 2003

(65) Prior Publication Data

US 2004/0219048 A1 Nov. 4, 2004

(30) Foreign Application Priority Data

Sep. 11, 2002 (JP) ..... 2002-264890

(51) Int. Cl.
*F03C 2/00* (2006.01)
*F04C 2/00* (2006.01)

(52) U.S. Cl. ..... 418/94; 418/55.1; 418/55.4; 418/55.6; 418/98

(58) Field of Classification Search ..... 418/94, 418/98, 55.1–55.6, 181
See application file for complete search history.

(56) References Cited

U.S. PATENT DOCUMENTS

| | | | | |
|---|---|---|---|---|
| 4,884,955 | A * | 12/1989 | Richardson, Jr. | 418/57 |
| 5,370,513 | A * | 12/1994 | Fain | 418/55.6 |
| 6,679,690 | B1 * | 1/2004 | Fushiki et al. | 418/55.5 |
| 6,709,247 | B1 * | 3/2004 | Clendenin et al. | 418/55.1 |

FOREIGN PATENT DOCUMENTS

| | | | |
|---|---|---|---|
| JP | A-60-224988 | | 11/1985 |
| JP | 61178589 | A * | 8/1986 |
| JP | 02264174 | A * | 10/1990 |
| JP | A-8-121366 | | 4/1996 |
| JP | A-8-93664 | | 5/1996 |
| JP | 11324944 | A * | 11/1999 |

* cited by examiner

*Primary Examiner*—Theresa Trieu
(74) *Attorney, Agent, or Firm*—Antonelli, Terry, Stout and Kraus, LLP.

(57) ABSTRACT

A second frame is arranged between a first frame and an orbiting scroll, and a central space and an outer peripheral space are sealed off by a seal portion, which is formed between an end surface of a shaft support of the orbiting scroll and the second frame. Also, a balance weight is arranged in a space between an underside of the second frame and the first frame. Thereby, most of an oil having lubricated respective shaft supports flows into the space below the second frame, and the oil accumulated in the space is discharged through an oil scavenge pipe into an oil reservoir in a lower portion of a closed vessel. Also, since the balance weight can be assembled from a side of the orbiting scroll in a state, in which the second frame is removed, it is possible to mount the balance weight close to the orbiting scroll.

14 Claims, 8 Drawing Sheets

SCROLL FLUID MACHINE

BACKGROUND OF THE INVENTION

The present invention relates to a scroll fluid machine, in which a refrigerant, air, or other compressible gases work, and specifically is preferable to be applied to scroll compressors of a cantilever bearing support construction used in refrigerating/air-conditioning equipment.

Scroll compressors are widely used, as compressors for refrigerating/air-conditioning equipment, in various fields, and are superior in efficiency, reliability and calmness to compressors of other systems.

As a conventional scroll fluid machines, there is one disclosed in, for example, JP-A-8-121366. A seal member is provided between an orbiting scroll member and a frame, and a backpressure chamber is formed on an opposed side of the orbiting scroll member to a wrap. The backpressure chamber comprises, on account of the seal member, a first space disposed centrally to be under pressure substantially equal to a discharge pressure, and a second space disposed on an outer peripheral side to be maintained at an intermediate pressure between a suction pressure and the discharge pressure. Lubricating oil accumulated at a bottom of a closed vessel is conducted to the first space and the second space is communicated through a small hole to a compression space in the course of compression. Also, the first space is communicated to a compressor bottom side via a drain oil path or a drain oil pipe to return the lubricating oil in the backpressure chamber to the bottom in the closed vessel.

JP-A-60-224988 describes a scroll fluid machine, in which a concave, annular chamber is provided on a side of an orbiting scroll close to a frame, a seal surface is provided on the frame opposed to the chamber, and a seal ring is provided in the annular chamber to divide backpressure chamber into a pressure chamber in a central region and a low-pressure chamber in an outer peripheral region. Also, gaps are provided between the orbiting scroll and the frame and between the seal ring and a bottom of the annular chamber to allow axial movements of the orbiting scroll, and the gap between the seal ring and the bottom of the annular chamber is communicated to the pressure chamber to prevent generation of an excessive containment pressure while an improvement in sealing quality of the seal ring is contemplated.

JP-A-8-93664 describes a scroll compressor, in which a balance weight is arranged in a backpressure chamber and which is of a cantilever bearing construction.

The conventional techniques take no sufficient account of entrainment of lubricating oil into a working fluid, which is sucked and compressed. In particular, with the arrangement, in which the balance weight is arranged in the backpressure chamber to provide for a cantilever bearing construction, oil for lubrication of a shaft support of an orbiting scroll member and a shaft support for a crankshaft is mixed with a working fluid having passed through a suction port, the lubricating oil of high-temperature heats the working fluid being compressed, and the working fluid solved into the lubricating oil bubbles and is recompressed together with the working fluid in the course of compression, whereby oil heating leakage loss is increased to cause a decrease in energy efficiency.

It is an object of the invention to provide a scroll fluid machine, in which entrainment of lubricating oil into a working fluid being sucked and compressed can be decreased and which can realize a cantilever bearing construction.

It is a further object of the invention to eliminate direct mixing of oil, which lubricates a shaft support of an orbiting scroll member and a shaft support for a crankshaft, with a working fluid having passed through a suction port, prevent heating of the working fluid by the lubricating oil during compression, and to decrease that oil heating leakage loss, which the working fluid solved into the lubricating oil bubbles and is recompressed into a working refrigerant in the course of compression to cause, to obtain a high energy efficiency.

It is a still further object of the invention to eliminate direct mixing of a working fluid and lubricating oil and to realize a small loss of oil via mixing (an amount of oil, which is carried outside a compressor together with a discharged gas).

It is a further object of the invention to improve reliability in shaft supports by equalizing pressures on the shaft supports substantially to a discharge pressure to suppress breakage of oil films conventionally generated on the shaft supports and caused by bubbling of a refrigerant.

BRIEF SUMMARY OF THE INVENTION

First characteristic features of the invention to attain the above object reside, in a scroll fluid machine comprising: a stationary scroll member; an orbiting scroll member to mesh with the stationary scroll member; a driver for driving the orbiting scroll member via a crankshaft having an eccentric pin portion; a frame joined with the stationary scroll member and having a shaft support to support the crankshaft; an Oldham's ring for preventing the orbiting scroll member from rotating on its axis; a closed vessel receiving these elements; the shaft support for the crankshaft being arranged only on a side closer to the orbiting scroll member than the driver, in that the scroll fluid machine comprises: a space formed by the frame, the stationary scroll member, the orbiting scroll member, and so on; a further frame provided in the space to be separable from the frame; a shaft support of the orbiting scroll member to engage with the eccentric pin portion of the crankshaft; a seal portion formed between an end surface of the shaft support of the orbiting scroll member and the further frame to divide the space into a central space substantially under a discharge pressure and an outer peripheral space under a lower pressure than that in the central space; an oil feed system, by which a lubricating oil accumulated in the closed vessel is supplied to the shaft support for the crankshaft and the shaft support of the orbiting scroll member; and a space formed between the frame and the further frame to be communicated to the central space and to arrange therein a balance weight.

Second characteristic features of the invention reside, in a scroll fluid machine comprising: a compression mechanism part composed of a stationary scroll member, an orbiting scroll member to mesh with the stationary scroll member, compression chambers formed between the both scroll members, and the like; a driver for driving the compression mechanism part; a closed vessel receiving therein the compression mechanism part and the driver to be substantially under a discharge pressure; a crankshaft rotated by the driver and having an eccentric pin portion to cause the orbiting scroll member to make orbiting movement; a first frame fixedly mounted in the closed vessel and having a shaft support to support the crankshaft; an Oldham's ring serving as a mechanism for preventing the orbiting scroll member from rotating on its axis; a shaft support of the orbiting scroll member configured to engage with the eccentric pin portion of the crankshaft and to be axially movable;

an oil feed system, by which a lubricating oil is supplied to the shaft support for the crankshaft and the shaft support of the orbiting scroll member, the shaft support for the crankshaft being arranged only on a side of closer to the compression mechanism part than the driver, in that the scroll fluid machine comprises: a space formed by the first frame, the stationary scroll member, the orbiting scroll member, and so on; a second frame provided in the space to be separable from the first frame; a seal portion making an end surface of the shaft support of the orbiting scroll member a seat surface and providing sealing between the seat surface and the second frame to thereby separate in pressure into a central space and an outer peripheral space; and a space formed between the first frame and the second frame to be communicated to the central space and to arrange therein a balance weight, and wherein a lubricating oil supplied to the respective shaft supports from the oil feed system flows into the central space or the space, in which the balance weight is arranged.

Third characteristic features of the invention reside, in a scroll fluid machine comprising: a compression mechanism part composed of a stationary scroll member, an orbiting scroll member to mesh with the stationary scroll member, compression chambers formed between the both scroll members, and the like; a driver for driving the orbiting scroll member through a crankshaft having an eccentric pin portion; a first frame having a shaft support to support the crankshaft; an Oldham's ring for preventing the orbiting scroll member from rotating on its axis; a closed vessel receiving therein these elements to be substantially under a discharge pressure; the shaft support for the crankshaft being arranged only on an upper side than the driver, in that the scroll fluid machine comprises: a space formed by the first frame, the stationary scroll member, the orbiting scroll member, and so on; a second frame provided in the space to be separable from the first frame; a seal portion formed between the orbiting scroll member and the second frame to divide the space into a central space substantially under a discharge pressure and an outer peripheral space under a lower pressure than that in the central space; an oil feed system, by which a lubricating oil accumulated in a lower portion of the closed vessel is supplied to the shaft support for the crankshaft and the shaft support of the orbiting scroll member; a lower space formed between an underside of the second frame and the first frame to be communicated to the central space communicated in pressure to the oil feed system; and a balance weight arranged in the lower space.

Fourth characteristic features of the invention reside, in a scroll fluid machine comprising: an orbiting scroll member having a spiral scroll wrap, which is provided upright on an end plate; a stationary scroll member having a spiral scroll wrap, which is provided upright on an end plate; compression chambers formed by meshing of the orbiting scroll member and the stationary scroll member with each other, and is decreased in volume with orbiting movement of the orbiting scroll member; drive means for causing orbiting movement of the orbiting scroll member through a crankshaft having an eccentric pin portion; a first frame having a shaft support to support the crankshaft; an Oldham's ring for preventing the orbiting scroll member from rotating on its axis; a shaft support of the orbiting scroll member to engage with the eccentric pin portion of the crankshaft; a space formed by the first frame and the stationary scroll member to arrange therein the orbiting scroll member and the Oldham's ring; a seal portion dividing in pressure the space into a central space and an outer peripheral space and making an end surface of the shaft support of the orbiting scroll member a seat surface; an oil feed system, by which a lubricating oil substantially at a discharge pressure is supplied to the shaft support for the crankshaft and the shaft support of the orbiting scroll member; a closed vessel receiving therein these elements to be substantially under the discharge pressure; the shaft support for the crankshaft being arranged only on a side closer to the compression chambers than the drive means; in that the scroll fluid machine comprises a second frame separable from the first frame and defining the seal portion between it and the end surface of the shaft support of the orbiting scroll member, and the seal portion, which is defined by the end surface of the shaft support of the orbiting scroll member and the second frame, separates a central space, into which the lubricating oil having been supplied to the respective shaft supports from the oil feed system flows and which is substantially under a discharge pressure, and an outer peripheral space under a lower pressure than that in the central space, and a lower space is formed between an upper portion of the shaft support of the first frame and a lower portion of the second frame to be communicated in pressure to the central space and to be arranged relative to the outer peripheral space under the lower pressure with the seal portion therebetween, and a balance weight is arranged in the lower space.

Preferably, seat surfaces of the seal portion are composed of the end surface of the shaft support of the orbiting scroll member and an upper surface of the second frame, and the first frame and the second frame are mechanically fastened to each other. Also, the stationary scroll member and the frame are preferably joined to each other by means of mechanical fastening means and positioning means in combination.

The second frame may be formed with a support (for example, a key groove) for the Oldham's ring and a support for a back surface of the orbiting scroll member.

Also, a concave support for thrust of the crankshaft is preferably provided on that back surface portion of the orbiting scroll member, which is opposed to an end surface of the eccentric pin portion. Further, when small holes are formed on a seat surface of a seal portion on the end surface of the shaft support of the orbiting scroll member to keep therein the lubricating oil, favorable lubrication can be achieved.

In addition, pressure in the outer peripheral space is a suction pressure or an intermediate pressure between the suction pressure and a discharge pressure.

Since an oil having been supplied to the respective shaft supports flows into the space, in which the balance weight is arranged, the oil can be efficiently returned to the oil reservoir by using an oil scavenge pipe for communication between the space, in which the balance weight is arranged, and the oil reservoir in the closed vessel.

In addition, the oil feed system is generally composed of oil feed passages formed in the crankshaft, and oil feed passages, through which the lubricating oil is supplied to the shaft support of the orbiting scroll member and the shaft support for the crankshaft, are preferably formed separately. Since an interior of the closed vessel is under the discharge pressure and the outer peripheral space is under the suction pressure or an intermediate pressure, their differential pressure makes it possible to supply the lubricating oil to the respective shaft supports via the oil feed passages. Alternatively, a surer oil feeding is made possible when an oil feed pump is provided to supply the lubricating oil to the oil feed system. Such oil feed pump is preferably one driven upon rotation of the crankshaft.

Preferably, an oil reservoir formed in a lower portion of the closed vessel and the driver are partitioned by a partition, the oil feed pump is mounted on the partition through a pump fixing member, and the oil feed pump is specifically configured to be movable relative to the pump fixing member in axial and radial directions of the crankshaft.

DETAILED DESCRIPTION OF THE INVENTION

Figure 1:
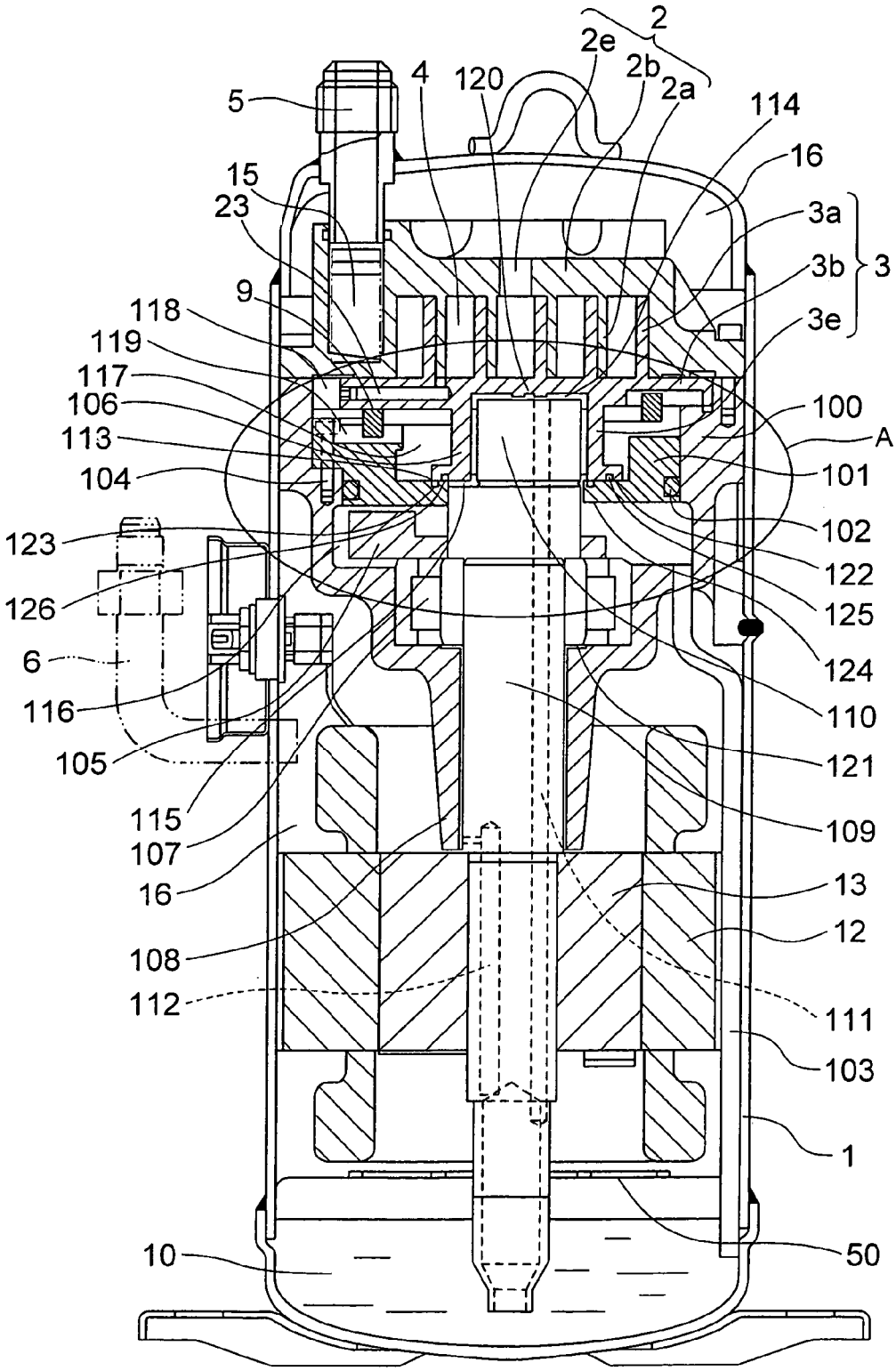
FIG. 1 is a longitudinal, cross sectional view showing an embodiment of the invention.

A first embodiment of the invention will be described with reference to FIGS. 1 and 2.

First, a whole construction of a scroll fluid machine according to the embodiment will be described with reference to FIG. 1.

Fundamental components of a compression section comprise a stationary scroll 2, an orbiting scroll 3, and a first frame 100, and the first frame 100 is fixed to a closed vessel 1. The stationary scroll 2 essentially comprises a wrap 2*a*, an end plate 2*b*, and a discharge port 2*e*, and the orbiting scroll 3 essentially comprises a wrap 3*a*, an end plate 3*b*, and a shaft support 3*e*. Compression chambers defined when the stationary scroll 2 and the orbiting scroll 3 mesh with each other are decreased in volume upon orbiting movement of the orbiting scroll 3 to perform compressive actions. Accompanying with the orbiting movement of the orbiting scroll 3, a working fluid is sucked into the compression chambers 4 via a suction port 5 and a suction space 15 and discharged from a discharge port 2*e* into a discharge space 16 through the compression stroke and discharged outside the closed vessel 1 through a discharge port 6.

A drive unit for orbitingly driving the orbiting scroll 3 comprises a stator 12 and a rotor 13 in the case where a rotary driver is an induction motor, a crankshaft 109, an eccentric pin portion 110 of the crankshaft 109, an Oldham's ring 9 for preventing the orbiting scroll 3 from rotating on its axis, and so on. The reference numeral 100 denotes a first frame, and a rolling bearing 107 and a slide bearing 108 are provided on the first frame to rotatably support the crankshaft 109. The orbiting scroll 3 and the eccentric pin portion 110 of the crankshaft 109 are engaged with each other by a shaft support 106 of the orbiting scroll in movable in a thrust direction and a rotational direction. A shaft support (the rolling bearing 107 and the slide bearing 108) for supporting the crankshaft is arranged on a side closer to the compression chambers than the driver. The reference numeral 101 denotes a second frame. The second frame is arranged together with the orbiting scroll in a space, defined by the first frame 100 and the stationary scroll 2, to partition the space vertically. The Oldham's ring 9 together with the orbiting scroll 3 is arranged in an upper space (spaces 117, 118), which is defined by the second frame 101 and the stationary scroll 2, around an outer peripheral of the shaft support 3*e* of the orbiting scroll. One set among two sets of orthogonal keys formed on the Oldham's ring 9 engages with a key groove 119, which is provided on the second frame 101 to bear the Oldham's ring 9, to slide therein, and the other set among the two sets engages with a key groove, which is provided on a back surface of the end plate of the orbiting scroll, to slide therein.

Figure 2:
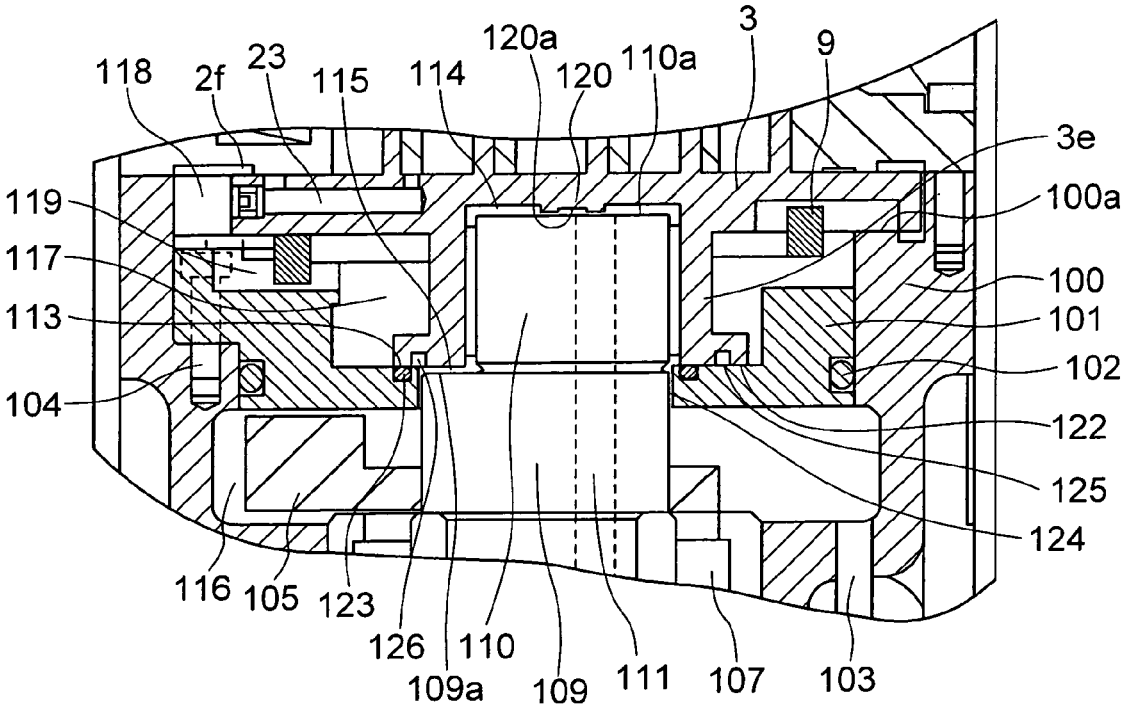
FIG. 2 is an enlarged view showing an A portion in FIG. 1.

FIG. 2 is an enlarged view showing an A portion in FIG. 1, and enlarging a neighborhood of a space defined by the first frame 100 and the stationary scroll 2. A seal material 113 provides sealing between an end surface 122 of the shaft support 3*e* of the orbiting scroll and the second frame 101. The seal material 113 is arranged in a groove (space) 123 formed on the second frame 101, and the seal portion separates in pressure a space, which is defined by the first frame 100, the second frame 101 and the stationary scroll 2, into central spaces 114, 115 and outer peripheral spaces 117, 118. The second frame 101 is made of a separate member from the first frame 100 and the second frame 101 is coupled with the first frame 100 by means of bolts 104. Here, in order to accumulate some amount of an oil in the central space 115 to supply a necessary amount of the oil to the outer peripheral spaces 117, 118, a space 124 on a side of the crankshaft must be ensured with high accuracy, and a knock pin (not shown) is preferably used in combination to serve as high-accuracy positioning means for the second frame 101. Also, since the second frame 101 is made of a separate member from the first frame 100, a seal material 102 is provided on that surface of the second frame 101, which engages with the first frame. In addition, such seal portion may be provided on a side of the first frame. The seal material 102 may be made of a fluoroplastic, polyimide resins, or the like as well as O-rings.

Two oil feed passages 111, 112 are formed in the crankshaft 109, and thus a lubricating oil accumulated in an oil reservoir 10 in a lower portion of the closed vessel 1 is supplied to the shaft supports 106 to 108 by an action of a centrifugal pump, which is realized by rotary motion of the crankshaft 109. The reference numeral 50 denotes a partition, by which the discharge space 16 and the oil reservoir 10 in the closed vessel are partitioned from each other.

The oil from the oil feed passage 111 reaches the central space 114 on the top of the crank pin portion 110 and then lubricates the shaft support 106 of the orbiting scroll to flow out to the central space 115. A very small amount (necessary amount) of the oil having flowed out to the central space 115 leaks to the outer peripheral space 117 through the seal material 113 provided on the end surface 122 of the shaft support 3*e* of the orbiting scroll but a major part of the oil passes through the space 124 on the side of the crankshaft to flow into a lower space 116. Also, the oil from the oil feed passage 112 successively lubricates the slide bearing 108 and the rolling bearing 107, which constitute shaft supports for the crankshaft, and thereafter flows out to the lower space 116. The oil having lubricated these shaft supports 106 to 108 flows into the lower space 116 and thereafter is returned to the oil reservoir 10 via an oil scavenge pipe 103. Arranged in the lower space 116 is a balance weight 105 for removing a rotational unbalance, which accompanies orbiting movement of the orbiting scroll. In addition, when a circumferential groove or an arcuate groove for communication with the oil scavenge pipe 103 is formed or a tapered portion directed toward an area around the oil scavenge pipe 103 is formed on a lower portion of the lower space (a space, in which the balance weight is arranged) 116, it is possible to decrease an action, in which the oil accumulated in the lower space is agitated when the balance weight 105 makes rotational movement, thus enabling returning the oil to the oil reservoir 10 more smoothly.

In this manner, according to the embodiment, most of the oil having lubricated the shaft support 106 of the orbiting scroll and the shaft supports 107, 108 for the crankshaft is returned to the oil reservoir 10, so that an amount of the lubricating oil, which is entrained into a working fluid (refrigerant gas) sucked from the suction port 5, can be made minimum.

In order to lubricate slide portions of the Oldham's ring 9 arranged in the outer peripheral space 117, small holes 125, 126 are formed on the end surface 122 of the shaft support of the orbiting scroll to provide intermittent communication between the central space 115 and the outer peripheral space 117. It suffices that these small holes 125, 126 be sized not to exceed a seat width of the seal material 113. In addition, it suffices that the number of the small holes 125, 126 be able to ensure a necessary amount of the oil, and there are some cases where the oil leaking from an area around the seal material 113 alone makes it possible to supply a necessary amount of the oil to the outer peripheral space 117 according to the working condition of a concerned scroll fluid machine, in which cases the small holes may be dispensed with.

While the central spaces 114, 115 and the space 116 (the lower space), in which the balance weight is arranged, are subjected to that pressure-rise action, which is caused by a pumping action, and that decompression, which is caused by passage through the bearing portions and gaps, they are pressure of the order of substantially the discharge pressure. The outer peripheral space 118 communicated to the outer peripheral space 117 is intermittently communicated to the compression chambers in the course of compression via a communication hole 23 and a groove 2*f* to be under pressure intermediate between the suction pressure and the discharge pressure. Pressures (the discharge pressure or intermediate pressures) in the spaces 114 to 118 presses a back surface of the end plate 3*b* of the orbiting scroll toward the stationary scroll 2 with an appropriate force to maintain gastightness for the compression chambers 4.

A thrust support 120 and a thrust bearing 121 are provided to bear loads generated in an axial direction of rotation, and the thrust support 120 bears a load when the crankshaft 109 is moved upward, and the thrust bearing 121 bears a load when the crankshaft 109 is moved downward. The thrust support 120 is a projection provided on the wrap back surface of the orbiting scroll and is provided centrally thereof with a recess 120*a* to prevent the oil feed passage 111 from being blocked when the crankshaft 109 comes into contact with the thrust support 120. Also, in order that the end surface 122 of the shaft support of the orbiting scroll comes into no contact with an end 109*a* of the crankshaft even when the crankshaft 109 is moved uppermost, an axial gap is provided between the thrust support 120 and an end 110*a* of the crank pin portion and an axial gap is provided between the central space 114 and the central space 115.

An important feature of the embodiment resides in that the second frame 101 separate from the first frame 100 is mounted in the first frame to be removable toward the orbiting scroll, and the balance weight 105 is arranged in the space 116 below the second frame. With such arrangement, the balance weight 105 together with the crankshaft 109 can be assembled from above in a state, in which the second frame 101 is removed. Also, a balance weight must be increased in weight for maintenance of a rotational balance with a conventional arrangement, in which shaft supports 107, 108 of a crankshaft are arranged on a side closer to compression chambers 4 than a driver and a balance weight 105 is provided in a discharge space 16. Therefore, it becomes necessary to enlarge the balance weight in shape, or to use an expensive material having a large density, which will bring about an increase in cost. In contrast, according to the embodiment, the balance weight can be mounted close to the orbiting scroll, so that the above conventional disadvantage can be cancelled. Further, although the balance weight is arranged in the space 116, in which the lubricating oil is collected, the second frame 101 and the seal material 113 also make it possible to minimize an amount of the lubricating oil, which is entrained into a sucked gas from the outer peripheral space.

Also, according to the embodiment, a seat surface for the end surface 122 of the shaft support of the orbiting scroll and the Oldham's ring support (key groove) 119 are provided on the second frame 101, which is effective in making a diametrical size of the scroll fluid machine compact. Further, since an orbiting back-surface support 100*a* can be provided on the first frame 100, a gap to the back surface of the end plate 3*b* of the orbiting scroll can be advantageously controlled with high accuracy. In addition, while the bolts 104 for fixation of the second frame are arranged around an outer periphery of the second frame, there is no need of providing the bolts over the entire circumference and it suffices that the number of the bolts is able to support a differential pressure acting on the second frame 101.

Also, according to the embodiment, since the oil having lubricated the shaft support 3*e* of the orbiting scroll and the shaft supports 107, 108 for the crankshaft is not mixed directly with the working fluid, which has passed through the suction port, it is possible to decrease heating of the working fluid by the lubricating oil and to decrease the oil heating leakage loss, which is resulted from that the working fluid (refrigerant) solved into the lubricating oil bubbles and is recompressed, so that it is possible to obtain a high energy efficiency. Further, since the lubricating oil is not mixed directly with the working fluid, it is also possible to decrease a loss of oil via mixing (an amount of an oil, which is carried outside the compressor together with a discharged gas). Also, since the shaft supports are under a substantially uniform discharge pressure over the entire lengths thereof, it is possible to suppress breakage of oil films due to bubbling of the refrigerant at the shaft supports, thus enabling maintaining reliability of the shaft supports high.

An example, in which the embodiment shown in FIGS. 1 and 2 is partially modified, will be described with reference to FIGS. 3 to 8. In these figures, parts denoted by the same reference numerals indicate the same or corresponding ones.

Figure 3:
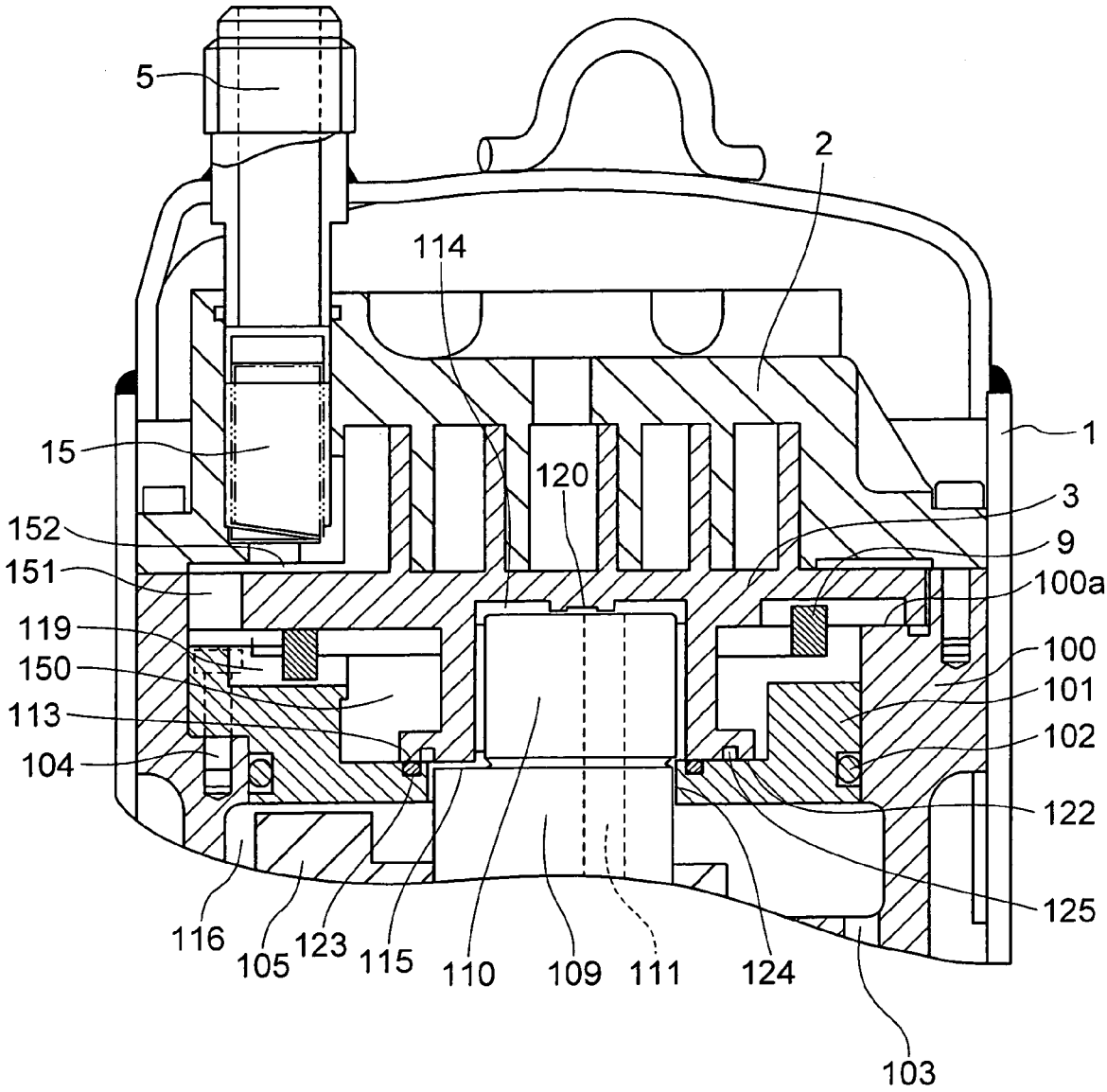
FIG. 3 is an enlarged view showing an essential part of a modification, in which the embodiment shown in FIG. 1 is modified.

A modification shown in FIG. 3 is different specifically in outer peripheral spaces 150, 151 from the arrangement shown in FIG. 2. While the central spaces 114, 115 and the space 116, in which the balance weight is arranged, are under pressure of the order of a discharge pressure, the outer peripheral space 151 communicated to the outer peripheral space 150 is communicated to suction spaces 15, 152 to be thereby under pressure of the order of a suction pressure. The spaces under the discharge pressure and the space under the suction pressure cause an appropriate force to press the end plate 3*b* of the orbiting scroll against the stationary scroll 2, thus maintaining gastightness for the compression chambers 4. When the force pressing the end plate of the orbiting scroll is too large, there are generated slide loss, seizure, and galling on slide portions of the stationary scroll and the orbiting scroll. Therefore, when a small pressing force is demanded, the use of "discharge pressure+suction pressure" can realize an appropriate pressing force as in the modification.

Figure 4:
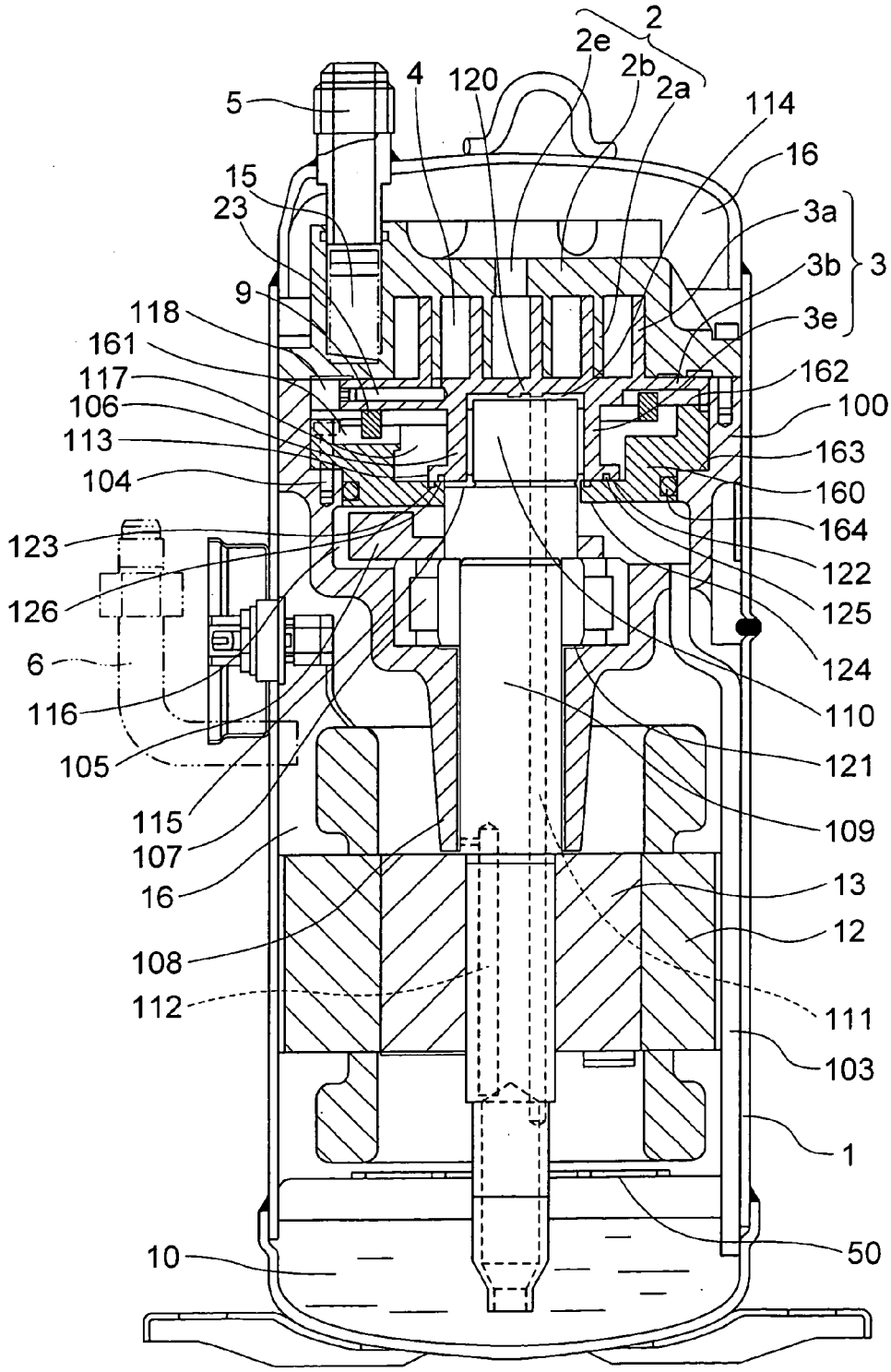
FIG. 4 is a longitudinal, cross sectional view showing a further modification, in which the embodiment shown in FIG. 1 is modified.

A further modification is shown in FIG. 4. The modification has a feature in the constitution of a second frame 160. More specifically, the second frame 160 comprises a support 162 for the back surface of the orbiting scroll as well as a seat surface for the end surface 122 of the shaft support of the orbiting scroll and a support 161 for the Oldham's ring. With the modification, sealing between the first frame 100 and the second frame can be provided in two locations by a seal material 164 provided on a side of the second frame, and a joint surface 163 of the second frame on the first frame 100. When the joint surface 163 provides for a seal surface, it is possible to dispense with the seal material 164 and the working of a seal portion therefor, thereby enabling reducing the number of parts and time for processing.

Figure 5:
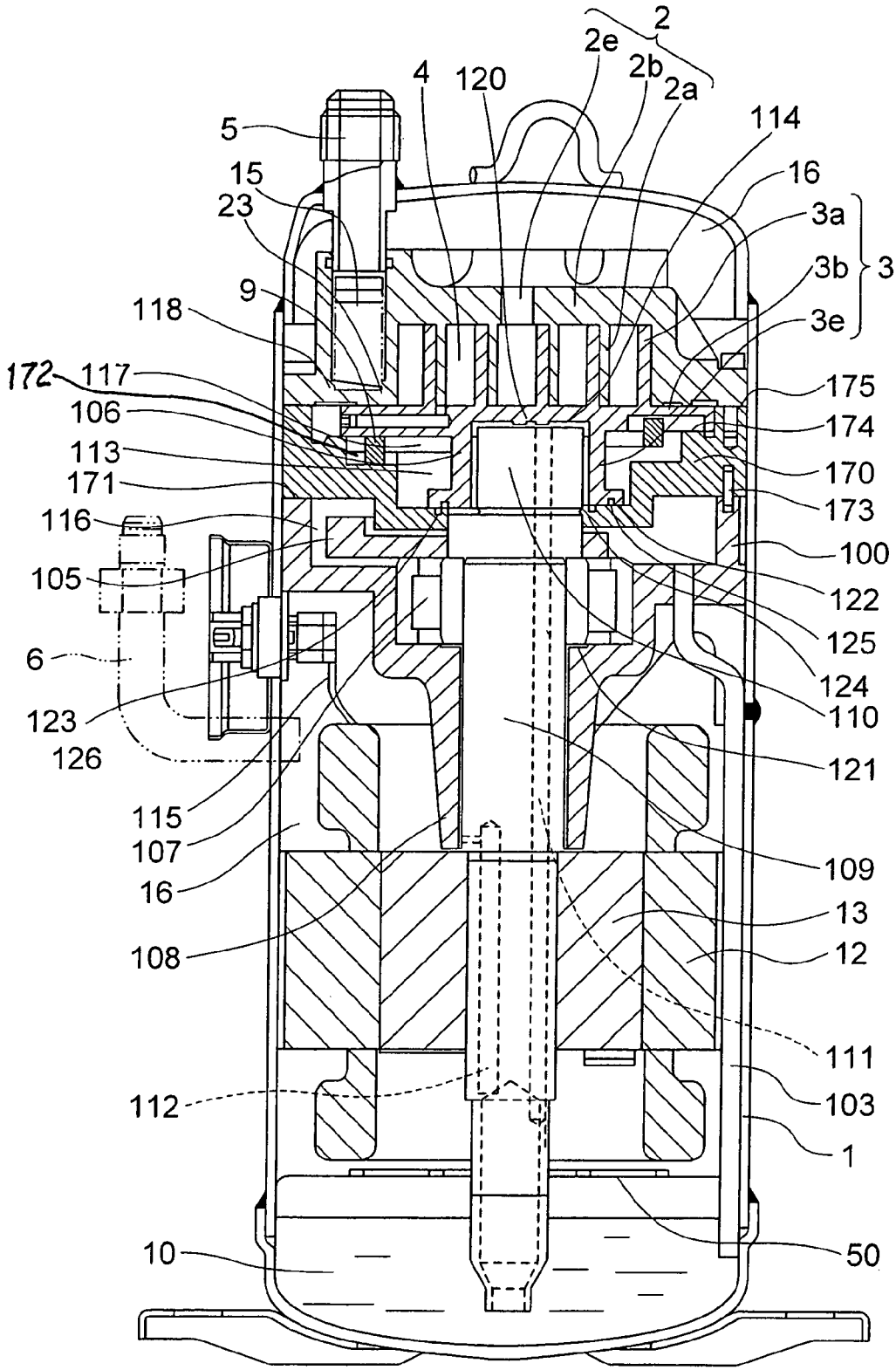
FIG. 5 is a longitudinal, cross sectional view showing a still further modification, in which the embodiment shown in FIG. 1 is modified.

A still further modification is shown in FIG. 5. The modification also has a feature in the constitution of a second frame 170. With the modification, the second frame 170 comprises a seat surface for the end surface 122 of the shaft support of the orbiting scroll, a support 172 for the Oldham's ring, a support 174 for the back surface of the orbiting scroll, and a fixing portion 175 for the stationary scroll 2. The stationary scroll 2, the first frame 100, and the second frame 170 may be fixed together by using through-bolts to fix the stationary scroll 2 and the first frame 100 to each other with the second frame 170 interposed therebetween, or by separately fixing the stationary scroll 2 and the second frame 170 to each other and fixing the second frame 170 and the first frame 100 to each other. Also, at the time of fixing the first frame and the second frame together, a knock pin 173 which is positioning means is preferably used in positioning with high accuracy. Division of the frame into upper and lower portions in such constitution makes it possible to increase a diametrical size of the space 116, in which the balance weight is arranged, so that it is possible to increase the space, in which the balance weight is arranged, and to have the balance weight shaped in cross section to decrease a loss in agitation.

Figure 6:
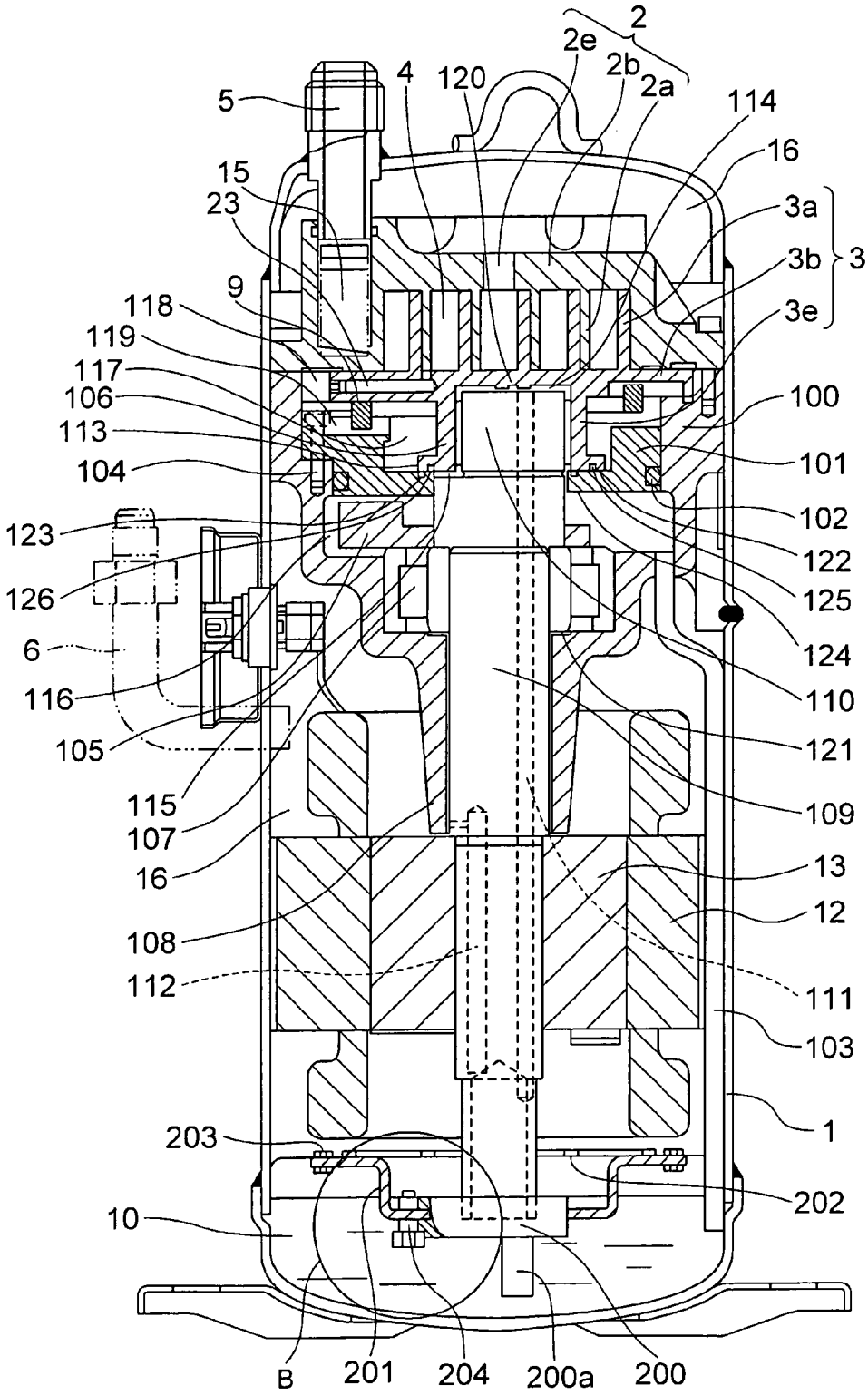
FIG. 6 is a longitudinal, cross sectional view showing a still further modification, in which the embodiment shown in FIG. 1 is modified.

A further modification is shown in FIG. 6. The modification uses an oil feed pump 200 for supplying a lubricating oil 10 accumulated in a lower portion of the closed vessel 1 to the respective shaft supports 106 to 108. The oil feed pump 200 is configured to have therein a pump rotating portion for rotation according to the rotation of the crankshaft 109 and to raise pressure of the oil sucked from an oil suction port 200*a* to discharge the oil to the oil feed passages 111, 112 provided in the crankshaft. The oil feed pump 200 is fixed to a partition 202, which is provided above an oil reservoir of the lubricating oil 10, through a pump fixing member 201. The pump fixing member 201 is fixed to the partition 202 by means of fastening bolts 203. With the arrangement as shown in the drawing, fixing is achieved by a combination of bolts and nuts but the partition 202 may be formed with threads to achieve joining with only bolts, or the partition 202 and the pump fixing member 201 may be integrally formed by welding or the like. The use of the oil feed pump 200 is effective in enabling surely supplying the oil to the respective shaft supports even at the time of low rotation.

Figure 7:
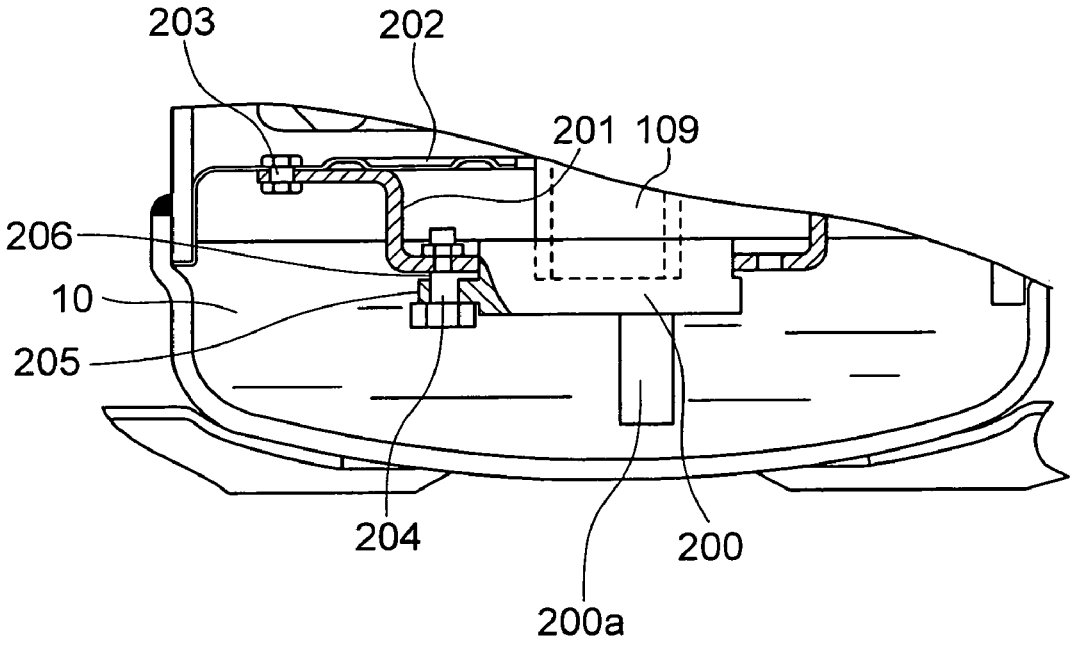
FIG. 7 is an enlarged view showing a neighborhood of a B portion in FIG. 6.

A concrete example, in which the oil feed pump 200 is mounted on the pump fixing member 201, will be described with reference to FIG. 7. The oil feed pump 200 is fixed to the pump fixing member 201 by means of bolts 204. As shown in the drawing, portions connected by the bolts 204 are formed with an axial gap 206 and a radial gap 205 to make the oil feed pump 200 slightly movable in axial and diametrical directions. Such arrangement can accommodate for an axial behavior of the crankshaft 109 and off-centering of the crankshaft generated in the assembly of the oil feed pump 200, so that an improvement in reliability can be achieved by preventing the oil feed pump from excessively restraining the crankshaft 109.

Figure 8:
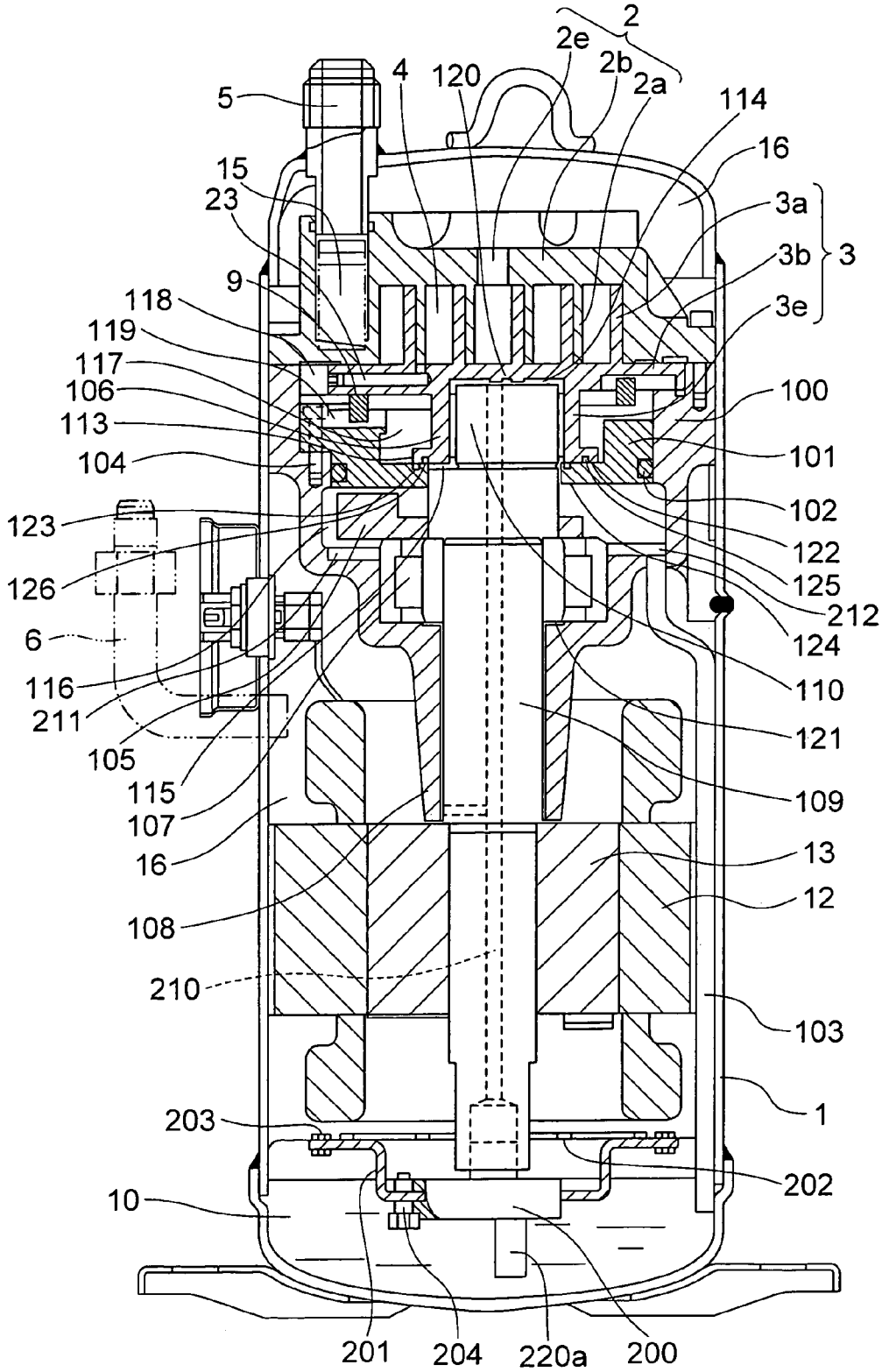
FIG. 8 is a longitudinal, cross sectional view showing a further modification, in which the embodiment shown in FIG. 1 is modified.

A further modification is shown in FIG. 8. With the modification, an oil feed path 210 for supplying of the lubricating oil to the respective shaft supports 106 to 108 is formed substantially centrally of the crankshaft 109 to extend therethrough axially. Such arrangement makes it possible to perform working simply and to achieve reduction in cost for the working. Also, with the modification, extension spaces 211, 212 are formed in the space 116, in which the balance weight is arranged, on the back surface side of the balance weight 105. These extension spaces function as spaces, into which the oil accumulated in the space 116, in which the balance weight is arranged, escapes from the respective shaft supports, whereby there is produced an effect that agitation loss caused by the balance weight can be decreased.

According to the invention, the second frame is arranged between the first frame and the orbiting scroll, and the seal portion formed between the end surface of the shaft support of the orbiting scroll and the second frame provides sealing between the central spaces and the outer peripheral space, whereby most of the oil flows into the space below the second frame and the oil accumulated therein is discharged to the oil reservoir in the lower portion of the closed vessel, so that the oil having lubricated the respective shaft supports becomes hard to mix directly with the working fluid having passed through the suction port, and so it is possible to suppress heating of the working fluid caused by the lubricating oil and to suppress bubbling and recompression of the working fluid solved into the lubricating oil. Accordingly, there is produced an effect to enable an increase in energy efficiency and a decrease in loss of the working fluid and the oil. Also, since the respective shaft supports are wholly maintained under a substantially discharge pressure, the working fluid solved into the lubricating oil becomes hard to bubble on the shaft supports whereby it is possible to suppress breakage of oil films, thus improving reliability of the shaft supports. Further, the balance weight can be assembled from a side of the orbiting scroll in a state, in which the second frame is removed, whereby the balance weight can be mounted close to the orbiting scroll to produce an effect that the balance weight can be made further lightweight.

Also, according to the invention, the balance weight is arranged in that space above the frame, into which the lubricating oil flows, so that there is produced an effect that mixing of the oil with the working fluid, which has passed through the suction port, can be suppressed even when the balance weight causes agitation and scattering of the oil.

What is claimed is:

1. A scroll fluid machine comprising:

a stationary scroll member;

an orbiting scroll member to mesh with the stationary scroll member;

a driver for driving the orbiting scroll member via a crankshaft having an eccentric pin portion;

a frame joined with the stationary scroll member and having a shaft support to support the crankshaft, the shaft support for the crankshaft being arranged only on a side closer to the orbiting scroll member than the driver;

an Oldham's ring for preventing the orbiting scroll member from rotating on its axis;

a closed vessel receiving these elements;

a space formed by the frame, the stationary scroll member, and the orbiting scroll member;

a further frame provided in the space to be separable from the frame;

a shaft support of the orbiting scroll member to engage with the eccentric pin portion of the crankshaft;

a seal portion formed between an end surface of the shaft support of the orbiting scroll member and the further frame to divide the space into a central space substantially under a discharge pressure and an outer peripheral space under a lower pressure than that in the central space;

an oil feed system, by which a lubricating oil accumulated in the closed vessel is supplied to the shaft support for the crankshaft and the shaft support of the orbiting scroll member; and a space, in which a balance weight is arranged, formed between the frame and the further frame to be communicated to the central space.

2. A scroll fluid machine according to claim 1, wherein the stationary scroll member and the frame are joined to each other by means of mechanical fastening means and positioning means in combination.

3. A scroll fluid machine according to claim 1, the orbiting scroll member is formed with a support for thrust of the crankshaft on a back surface portion thereof, which is opposed to an end surface of the eccentric pin portion.

4. A scroll fluid machine according to claim 1, the orbiting scroll is formed with small holes for keeping the lubricating oil on a seat surface of the seal portion of the end surface of the shaft support of the orbiting scroll member.

5. A scroll fluid machine according to claim 1, wherein pressure in the outer peripheral space is a suction pressure or an intermediate pressure between the suction pressure and a discharge pressure.

6. A scroll fluid machine according to claim 1, further comprising an oil scavenge pipe for communication between the space, in which the balance weight is arranged, and that portion of the closed vessel, in which the lubricating oil is accumulated.

7. A scroll fluid machine according to claim 1, wherein the oil feed system comprises oil feed passages formed in the crankshaft and an oil feed pump for supplying the lubricating oil to the oil feed passages, and the oil feed passages for supplying the lubricating oil to the shaft support of the orbiting scroll member and the shaft support for the crankshaft are formed separately from each other.

8. A scroll fluid machine according to claim 7, wherein an oil reservoir formed in a lower portion of the closed vessel and the driver are partitioned by a partition, the oil feed pump is mounted on the partition through a pump fixing member, the oil feed pump being driven according to rotation of the crankshaft, and the oil feed pump is configured to be movable relative to the pump fixing member in axial and radial directions of the crankshaft.

9. A scroll fluid machine comprising:

a compression mechanism part comprising a stationary scroll member, an orbiting scroll member to mesh with the stationary scroll member, and compression chambers formed between the both scroll members;

a driver for driving the compression mechanism part;

a closed vessel receiving the compression mechanism part and the driver to be substantially under a discharge pressure;

a crankshaft rotated by the driver and having an eccentric pin portion for causing the orbiting scroll member in an orbiting movement;

a first frame fixedly mounted in the closed vessel and having a shaft support to support the crankshaft, the shaft support for the crankshaft being arranged only on a side closer to the compression mechanism part than the driver;

an Oldham's ring serving as a mechanism for preventing the orbiting scroll member from rotating on its axis;

a shaft support of the orbiting scroll member configured to engage with the eccentric pin portion of the crankshaft and to be axially movable;

an oil feed system, by which a lubricating oil is supplied to the shaft support for the crankshaft and the shaft support of the orbiting scroll member;

a space formed by the first frame, the stationary scroll member, and the orbiting scroll member;

a second frame provided in the space to be separable from the first frame;

a seal portion making an end surface of the shaft support of the orbiting scroll member a seat surface and providing sealing between the seat surface and the second frame to thereby make separation in pressure between a central space and an outer peripheral space; and a space, in which a balance weight is arranged, formed between the first frame and the second frame to be communicated to the central space, wherein a lubricating oil supplied to the respective shaft supports from the oil feed system flows into the central space or the space, in which the balance weight is arranged.

10. A scroll fluid machine according to claim 9, wherein the seal portion includes the end surface of the shaft support of the orbiting scroll member and an upper surface of the second frame as seat surfaces, and the first frame and the second frame are mechanically fastened to each other.

11. A scroll fluid machine according to claim 9, the second frame is provided with a support for the Oldham's ring.

12. A scroll fluid machine according to claim 11, wherein the second frame is formed with a key groove for engagement with a key on the Oldham's ring, and a support for a back surface of the orbiting scroll member.

13. A scroll fluid machine comprising:

a compression mechanism part comprising a stationary scroll member, an orbiting scroll member to mesh with the stationary scroll member, and compression chambers formed between the both scroll members;

a driver for driving the orbiting scroll member through a crankshaft having an eccentric pin portion;

a first frame having a shaft support to support the crankshaft, the shaft support for the crankshaft being arranged only on an upper side of the driver;

an Oldham's ring for preventing the orbiting scroll member from rotating on its axis;

a closed vessel receiving these elements to be substantially under a discharge pressure;

a space formed by the first frame, the stationary scroll member, and the orbiting scroll member;

a second frame provided in the space to be separable from the first frame;

a seal portion formed between the orbiting scroll member and the second frame to divide the space into a central space substantially under a discharge pressure and an outer peripheral space under a lower pressure than that in the central space;

an oil feed system, by which a lubricating oil accumulated in a lower portion of the closed vessel is supplied to the shaft support for the crankshaft and the shaft support of the orbiting scroll member;

a lower space formed between an underside of the second frame and the first frame to be communicated to the central space communicated in pressure to the oil feed system, and a balance weight arranged in the lower space.

14. A scroll fluid machine comprising:

an orbiting scroll member having a spiral scroll wrap, which is provided upright on an end plate;

a stationary scroll member having a spiral scroll wrap, which is provided upright on an end plate;

compression chambers formed by meshing of the orbiting scroll member and the stationary scroll member with each other, and decreased in volume with orbiting movement of the orbiting scroll member;

drive means for orbitingly driving the orbiting scroll member through a crankshaft having an eccentric pin portion;

a first frame having a shaft support to support the crankshaft, the shaft support for the crankshaft being arranged only on a side of the drive means to the compression chambers;

an Oldham's ring for preventing the orbiting scroll member from rotating on its axis;

a shaft support of the orbiting scroll member to engage with the eccentric pin portion of the crankshaft;

a space formed by the first frame and the stationary scroll member to arrange therein the orbiting scroll member and the Oldham's ring;

a seal portion dividing in pressure the space into a central space and an outer peripheral space and making an end surface of the shaft support of the orbiting scroll member a seat surface;

an oil feed system, by which a lubricating oil substantially at a discharge pressure is supplied to the shaft support for the crankshaft and the shaft support of the orbiting scroll member; and a closed vessel receiving therein these elements to be substantially under the discharge pressure; wherein there is provided a second frame separable from the first frame and defining the seal portion between it and the end surface of the shaft support of the orbiting scroll member, and the seal portion, which is defined by the end surface of the shaft support of the orbiting scroll member and the second frame, separates a central space, into which the lubricating oil having been supplied to the respective shaft supports from the oil feed system flows and which is substantially under a discharge pressure, and an outer peripheral space under a lower pressure than that in the central space, and a lower space is formed between an upper portion of the shaft support of the first frame and a lower portion of the second frame to be communicated in pressure to the central space and to be arranged relative to the outer peripheral space under the lower pressure with the seal portion therebetween, and a balance weight is arranged in the lower space.

* * * * *